United States Patent [19]

Seiter et al.

[11] Patent Number: 4,849,125

[45] Date of Patent: Jul. 18, 1989

[54] PROCESS FOR PREPARING A PHOSPHATE-REDUCED GRANULAR DETERGENT

[75] Inventors: Wolfgang Seiter, Neuss; Otto Koch, Leichlingen, both of Fed. Rep. of Germany

[73] Assignee: Henkel Kommonditgesellschaft auf Aktien, Duesseldorf, Fed. Rep. of Germany

[21] Appl. No.: 945,756

[22] Filed: Dec. 23, 1986

[30] Foreign Application Priority Data

Dec. 23, 1985 [DE] Fed. Rep. of Germany ..... 3545947

[51] Int. Cl.[4] ..... C11D 3/12; C11D 11/02; C11D 3/37

[52] U.S. Cl. ..... 252/109; 252/174.19; 252/174.24; 252/174.25; 252/135; 252/531; 252/536; 252/538; 252/539; 252/540; 252/132; 252/174.18

[58] Field of Search ..... 252/135, 140, 174.25, 252/174.24, 559

[56] References Cited

U.S. PATENT DOCUMENTS 4,136,051 1/1979 Saran et al. ..... 252/91
4,379,080 4/1983 Murphy ..... 252/526
4,414,130 11/1983 Cheng ..... 252/140
4,552,681 11/1985 Koch et al. ..... 252/140
4,652,391 3/1987 Balk ..... 252/99
4,661,281 4/1987 Seiter et al. ..... 252/140
4,707,290 11/1987 Seiter et al. ..... 252/140

FOREIGN PATENT DOCUMENTS 3248022 6/1984 Fed. Rep. of Germany .

*Primary Examiner*—Prince E. Willis
*Attorney, Agent, or Firm*—Ernest G. Szoke; Wayne C. Jaeschke; Real J. Grandmaison

[57] ABSTRACT

A phosphate-reduced, granular free-flowing detergent containing (a) from 5 to 40% nonionic surfactant, (b) from 3 to 20% anionic surfactant, (c) from 15 to 50% zeolite, (d) from 0.5 to 15% homopolymeric or copolymeric carboxylic acid or alkali metal salts thereof and (e) from 10 to 72.5% detergent constituents which are stable under spray-drying conditions, with the proviso that the detergent comprises a mixture of two powder components (A) and (B) in a weight ratio of from 1:5 to 3:1, component (A) containing from 50 to 100% of constituent (a), from 80 to 100% of constituent (c) and from 50 to 100% of constituent (d). Component (A) has an average particle size of from 0.4 to 0.8 mm and a powder density of from 500 to 800 g/l. Component (B) contains from 80 to 100% of constituent (b) and 100% of constituent (e), has a powder density of from 300 to 500 g/l and differs in its particle size distribution by at most 50% from the particle size distribution of component (A).

22 Claims, No Drawings

PROCESS FOR PREPARING A PHOSPHATE-REDUCED GRANULAR DETERGENT

BACKGROUND OF THE INVENTION

1. Field of the Invention

This invention relates to a phosphate-reduced detergent consisting of several granular powder components and containing finely-divided crystalline zeolites, nonionic surfactants selected from the group consisting of polyglycolether derivatives, anionic surfactants, and homopolymeric or copolymeric carboxylic acids as its essential constituents, and optionally sodium tripolyphosphate, in a particular powder distribution.

2. Discussion of Related Art

Finely-divided zeolites of the NaA and NaX type have been repeatedly proposed as phosphate substitutes in detergent compositions. However, it has been found that they must be present in the detergent in quantities of at least 20% by weight, and preferably in quantities of at least 25% by weight, in order to obtain a good detergent effect and, in particular, to minimize fabric incrustation. Unfortunately, considerable problems are involved in incorporating quantities as large as these in a detergent composition by spray drying. In the interests of energy conservation and efficient utilization of the hot spray drying towers, it is desirable to keep the water content of the mixture to be spray-dried as low as possible. The mixtures to be spray-dried normally contain from 30 to at most 45% by weight water, of which from 8 to 15% by weight remains in the product after spray drying. The synthetic zeolites are generally processed in the form of a filter-moist, stabilized suspension containing about 50% water which is particularly suitable for further processing. The addition of further, sprayable detergent constituents frequently containing water may then lead to a further increase in the water content of the slurry and, hence, to an increased energy demand and to a loss of capacity in the spray-drying plants.

If the zeolite is added to the slurry as a predried powder in order o reduce the water content of the slurry, zeolite agglomerates may be formed which tend to deposit on the textiles during the washing process. These problems may especially occur when the compositions contain water-soluble silicates like sodium waterglass.

Additional problems arise during spray-drying of phosphate-reduced washing compositions. As it is known, a certain percentage of the tripolyphosphate incorporated into the slurry is hydrolyzed to orthophosphate and pyrophosphate in the course of the spray drying process. These hydrolyzed phosphates favor the formation of incrustations on the washed textiles. It has been found that with decreasing phosphate content in the composition, the portion of the undesirable ortho- and pyrophosphates increases to the disadvantage of the tripolyphosphate content. Therefore, particularly in low-phosphate compositions the portion of the phosphates that induce incrustation is particularly high. Removing the phosphate from the spraying process and post-dosing it to the separately prepared powder will create new problems, especially if also the zeolite is not processed via spray-drying. In this case, the amount of inorganic carrier substance in the slurry would be too low with respect to the organic ingredients. Thus, the risk of dust explosions in the hot spray tower would increase and the formation of dry, free-flowing beads would be made more difficult.

Another problem is created by the use of nonionic surfactants. These compounds, which are distinguished by very high detergency, undesirably increase the viscosity of the spray-dried slurry where anionic surfactants are simultaneously present. In addition, they give rise to aerosol formation, so-called "pluming", in the offgases from the spray-drying tower. According to German Application No. 22 04 842-A 1, the nonionic surfactants are applied to a carrier powder which contains, inter alia, bentonite and microfine silicon dioxide, a particularly effective binder. This premix may then be added to a spray-dried detergent powder. However, silicon dioxide is not a washing-active constituent, i.e., it merely results in additional costs and makes no contribution to the detergent effect. The premix is prepared by granulating the powder-form carriers with the liquid or molten nonionic surfactant. The production of uniform granulates having a defined grain spectrum and powder density by this process involves considerable difficulties. Accordingly, mixtures of these granulates with spray-drying powders of low specific gravity also have a more or less irregular grain spectrum and show a tendency towards separation.

According to German Application No. 25 07 926-B 1, finely-divided crystalline aluminosilicates which, in regard to their composition include zeolites of the NaA and NaX type, are proposed for use as carrier material for the nonionic surfactants. In this case, too, the starting material used is a powder-form zeolite. There is nothing in this literature reference either to suggest that, to prepare this premix, it is necessary to start out with a prepared granulate having a certain grain specification and, as described hereinafter, certain additives and quantitative ratios in order to avoid subsequent separation of the granulate and to obtain optimal detergent properties.

A detergent product consisting of three powder-form or granular powder components is known from German Application No. 27 53 680 A2. The first powder component consists of a spray-dried powder and contains anionic and/or nonionic surfactants, builder salts, including phosphates, zeolites, alkali metal silicates and carbonates. The second component consists of builder salts serving as carrier material and silicone foam inhibitors adsorbed thereon. The third component consists of a granulate prepared from perborate or another per compound and one or more builders, preferably phosphates, using nonionic surfactants as binder. However, the uptake capacity of perborate for nonionic surfactants is very limited, although this is not critical in the present case because the third powder component only performs the function of improving the wetting properties and, hence, the flush-in behavior of the powder mixture in washing machines. However, relatively small amounts of nonionic surfactant or of the third powder component are sufficient for this purpose. The notion of using a prepared, phosphate-free carrier granulate which, by virtue of its special composition and method of production, is capable of taking up large amounts of nonionic surfactants is foreign to this publication. In addition, there is nothing in the cited application to show how the aluminosilicates, polycarboxylates and surfactants optionally used should be distributed among the individual powder components in order to obtain optimal detergency with phosphate-free detergents.

The object of the present invention is to solve the following problems or to bring a solution nearer to fruition.

1. Providing a phosphate-reduced detergent which is comparable with a conventional phosphate-containing detergent in its soil removal, i.e., primary detergency, and incrustation prevention, i.e., secondary detergency.
2. Decreasing the hydrolyzing rate of the tripolyphosphate (if present) and reducing the amount of organic compounds in the slurry and the hot spraying tower.
3. Increasing the percentage of zeolite in the detergent while, at the same time, easing the load on the spray-drying towers and avoiding an excessive energy demand.
4. Avoiding the formation of zeolite agglomerates.
5. Developing a carrier material having a high abrasive resistance and being completely dispersible in water without forming coarse particles, which carrier material is capable of taking up large amounts of nonionic surfactants and of increasing the percentage of zeolite in the final detergent and converting it into a premix which, by virtue of its grain spectrum, is suitable for mixing with a spray-dried powder.
6. Influencing the weight per liter of the final detergent by correspondingly formulating the premix with the object of reducing the packing volume by increasing the weight per liter of the product.
7. Improving the powder properties in regard to grain strength and dust formation, avoiding separation, obtaining good flow properties both immediately after production and also after storage for several months and obtaining favorable disintegration and dissolving properties on introduction into the wash liquor and on flushing into the washing machine with cold tapwater.
8. Maintaining the suitability of the multicomponent mixtures for taking up further powder components, for example those containing bleaches, per-acid precursors, enzymes and foam inhibitors.

DESCRIPTION OF THE INVENTION

Other than in the operating examples, or where otherwise indicated, all numbers expressing quantities of ingredients or reaction conditions used herein are to be understood as modified in all instances by the term "about".

The present invention relates to a detergent composition containing less than 5% by weight phosphorous in the form of phosphates comprising a mixture of at least two granular powder components (A) and (B), wherein component (A) comprises finely-divided crystalline synthetic zeolites of the NaA type and, optionally, the NaX type, and also nonionic surfactants selected from the group consisting of polyglycolether derivatives, and component (B) comprises a spray-dried detergent, wherein the mixture of the two components comprises the following constituents:

(a) from 4 to 40% by weight of nonionic surfactants;
(b) from 3 to 20% by weight of anionic surfactants, the ratio by weight of (a) to (b) being from 3:1 to 1:2;
(c) from 15 to 50% by weight of finely-divided crystalline zeolite;
(d) from 0.5 to 15% by weight, expressed as free acid, of homopolymeric or copolymeric carboxylic acids having a molecular weight of from 1000 to 120,000 and the sodium or potassium salts thereof;
(e) from 0 to 20% by weight of sodium tripolyphosphate; and
(f) from 10 to 72.5% by weight of other detergent constituents which are stable under the spray-drying conditions;

with the proviso that the ratio by weight of component (A) to component (B) is from 1:5 to 3:1, and powder component (A) contains from 50 to 100% of constituent (a), from 80 to 100% of constituent (c) and from 50 to 100% of constituent (d) and has a powder density of from 500 to 800 g/l and an average particle size of from 0.4 to 0.8 mm, the percentage of particles larger than 1.6 mm and of particles smaller than 0.1 mm not exceeding 1% by weight in either case, and with the further proviso that powder component (B) contains from 80 to 100% of constituent (b) and 100% of constituent (e) and has a powder density of from 300 to 550 g/l and a particle size distribution which differs by not more than 50% from that of component (A) for the same boundary conditions.

The starting material for powder component (A) is a granular adsorbent having the following composition:

(A 1) from 20 to 30 parts by weight of finely-divided crystalline, synthetic zeolite NaA and, optionally NaX containing bound water,
(A 2) from 0.5 to 7.5 parts by weight of a homopolymeric or copolymeric carboxylic acid having a molecular weight of from 1000 to 120,000 in the form of the sodium or potassium salt,
(A 3) from 3 to 6 parts by weight of water which is removable at a drying temperature of 145° C.,
(A 4) from 0 to 10 parts by weight of sodium sulfate, sodium carbonate or mixtures thereof,
(A 5) from 0 to 2 parts by weight of a nonionic surfactant selected from the group consisting of polyglycolether derivatives, and
(A 6) from 0 to 10 parts by weight of sodium nitrilotriacetate.

The granular adsorbent has an average particle size of from 0.4 to 0.8 mm, wherein the percentage having a particle size of smaller than 0.1 mm and the percentage having a particle size of larger than 1.6 mm does not exceed 1% by weight in either case. The powder density is from 400 to 700 g/l, and preferably from 450 to 650 g/l.

Constituent (A 1) comprises synthetic sodium aluminosilicate containing bound water, preferably of the zeolite A type. Zeolite NaX and mixtures thereof with zeolite NaA may also be used. The suitable zeolites have a calcium binding power which is determined in accordance with German Application No. 24 12 837 and which is in the range of from 100 to 200 mg CaO/g. They are preferably used in the form of undried, stabilized suspensions still moist from their production.

Constituent (A 2) comprises a homopolymeric and/or copolymeric carboxylic acid or a sodium or potassium salt thereof, sodium salts being preferred. Suitable homopolymers are polyacrylic acid, polymethacrylic acid and polymaleic acid. Suitable copolymers are those of acrylic acid with methacrylic acid and copolymers of acrylic acid, methacrylic acid or maleic acid with vinylethers, such as vinylmethylether or vinylethylether, and with vinylesters, such as vinylacetate or vinylpropionate, acrylamide, methacrylamide and also with ethylene, propylene or styrene. In copolymeric acids such as these, in which one of the components does not contain an acid function, the proportion thereof is no more than 70 mole % and preferably less than 60 mole % in the interests of adequate solubility in water. Copolymers of acrylic acid or methacrylic acid with maleic acid of the type described, for example, in European Application No. 25 551-B 1 have proved to be particularly suitable. The copolymers in question contain from 40 to 90% by weight acrylic acid or methacrylic acid and from 50 to 10% by weight maleic acid. Copolymers containing from 50 to 85% by weight acrylic acid and from 50 to 15% maleic acid are particularly preferred.

It is also possible to use polyacetal carboxylic acids of the type described, for example, in U.S. Pat. Nos. 4,144,226 and 4,146,495 and obtained by polymerization of esters of glycolic acid, introduction of stable terminal groups and saponification to the sodium or potassium salts. Polymeric acids obtained by polymerization of acrolein and disproportionation of the polymer pursuant to Canizzaro reaction using strong alkalis are also suitable. They are essentially made up of acrylic acid units and vinylalcohol units or acrolein units.

The molecular weight of the homopolymers or copolymers comprising constituent (A 2) is generally from 1000 to 120,000 and preferably from 1500 to 100,000. They are present in the adsorbent in a quantity of from 0.5 to 7.5 parts by weight and preferably in a quantity of from 1 to 5 parts by weight. The abrasion resistance of the particles increases with increasing content of polyacid or polyacid salts. Optimal abrasion properties are provided by mixtures containing from 2 to 3 parts by weight polyacid or salts thereof, based in each case on the above-described granulate.

The moisture content removable from the aluminosilicates at a drying temperature of 145° C. comprises from 3 to 6 parts by weight and preferably from 3.5 to 5 parts by weight. Further amounts of water bound by the zeolite and released at higher temperatures are not included in this content.

The optional constituent (A 4), which comprises sodium sulfate and/or sodium carbonate, preferably sodium sulfate, acts as a stabilizer in aqueous zeolite dispersions and can improve the dissolving rate of the granulates in cold water to a certain extent. Additions of from 0.2 to 5 parts by weight have proved suitable for this purpose.

The adsorbent may contain nonionic surfactants in quantities of up to 2 parts by weight and preferably in quantities of from 0.2 to 1.5 parts by weight as further optional constituent (A 5). Suitable nonionic surfactants include, in particular, ethoxylation products of linear or methyl-branched (oxo residue) alcohols containing from 12 to 18 carbon atoms and from 3 to 15 and preferably from 4 to 6 ethylene glycolether groups. Other suitable nonionic surfactants include ethoxylation products of vicinal diols, amines, thioalcohols and fatty acid amides which correspond to the described fatty alcohol ethoxylates in regard to the number of carbon atoms in the hydrophobic residue and in regard to the glycolether groups. Alkylphenol polyglycolethers containing from 5 to 12 carbon atoms in the alkyl group, and from 3 to 15, and preferably from 4 to 6 ethylene glycolether groups are also suitable. Finally, block polymers of ethylene oxide and propylene oxide of the type commercially available under the trade name of Pluronics® may also be used. The nonionic surfactants are normally present when the granular adsorbents are prepared from aqueous zeolite dispersions in which the surfactants function as dispersion stabilizers. In individual cases, the nonionic surfactants may even be completely or partly replaced by other dispersion stabilizers of the type described in German Application No. 25 27 388. In addition, component (A) may contain optical brighteners to improve whiteness. In that case, the proportion of brighteners in component (B) may be reduced accordingly.

A further optional constituent (A 6), which can partly substitute the compound (d), is sodium nitrilotriacetate (NTA). NTA may be used in amounts up to 10 parts by weight, preferably 0.5 to 6 parts by weight. It is well known that NTA increases the hygroscopic properties of detergent powders. Surprisingly it was found, that this disadvantage will be overcome if NTA is completely or largely present in powder component (A).

Moreover, the granular adsorbent component (A) must be free of alkali metal silicates, preferably free of sodium silicate. Water soluble silicates tend to reduce the dispersing properties of zeolite in the washing liquor.

The granular adsorbent is prepared by spray-drying an aqueous mixture of the ingredients generally containing from 50 to 65% by weight water by means of nozzles into a free-fall zone into which drying gases are introduced either in countercurrent or in parallel current flow, these drying gases having an entry temperature of from 150° to 280° C. and an exit temperature of from 50° to 120° C. The dried particles should have a moisture content which is removable at 145° C. of from 8 to 18 parts by weight.

The water content of the aqueous slurry mixture is preferably from 55 to 62% by weight. Its temperature is preferably in the range of from 50° to 100° C., while its viscosity is preferably in the range of from 5000 to 20,000 mPa.s. The spraying pressure is generally in the range of from 20° to 120 bar, and preferably in the range of from 30° to 80 bar. The drying gas which is generally obtained by burning heating gas or fuel oil is preferably guided in countercurrent flow. Where so-called drying towers into which the aqueous mixture is sprayed in the upper part thereof through several high-pressure nozzles are used, the entry temperature as measured in the annular duct, i.e., immediately before entry into the lower part of the tower, is in the range of from 150° to 280° C., preferably in the range of from 180° to 250° C. and more preferably in the range of from 190° to 230° C. The moisture-laden offgas leaving the tower normally has a temperature of from 50° to 120° C. and preferably of from 55° to 105° C.

The dried granular adsorbent consists essentially of rounded particles which show very good flow properties. These very good flow properties exist even when the particles are impregnated with large amounts of nonionic surfactants which may comprise up to 40% by weight, based on the adsorbate. In regard to these properties, the granular adsorbent is superior to the hitherto known carrier materials proposed as suitable for detergents and cleaning preparations.

The granular adsorbent is subsequently impregnated with nonionic surfactants. These nonionic surfactants may be sprayed both onto the still warm spray-dried product and onto the already cooled spray-dried product or onto the spray-dried product reheated after cooling. Providing the described quantitative ratios and production conditions are observed, the abrasion resistance and dimensional stability of the particles is so high that even the freshly prepared particles, but especially the cooled and optionally reheated, aged particles may be treated with the liquid additives, mixed and transported under the usual spray-mixing conditions without any fines or relatively coarse agglomerates being formed.

The nonionic surfactants applied to the granular adsorbent may be of the same type as those mentioned above for stabilizing the zeolite dispersion. Preferred nonionic surfactants are derived from primary fatty alcohols of natural or synthetic origin which may be saturated, mono-unsaturated, linear or methylbranched in the 2-position (oxo function) and may contain from 10 to 18 carbon atoms. Suitable fatty alcohols are lauryl alcohol, myristyl alcohol, cetyl alcohol, stearyl alcohol, oleyl alcohol and mixtures thereof of the type present, for example, in coconut oil fatty alcohol or tallow fatty alcohol. The average number of glycolether groups present therein is from 3 to 16. Particularly suitable fatty alcohols are mixtures containing components of relatively low and relatively high degrees of ethoxylation, for example those having a degree of ethoxylation of from 4 to 6 and those having a degree of ethoxylation of from 9 to 14, the mixing ratio generally being from 4:1 to 1:4.

The granular adsorbent is also suitable for taking up surface-active compounds containing amino or amide groups which may optionally be ethoxylated and which are insoluble or only sparingly soluble, but dispersible in water. In many cases, they enhance the primary detergency and are distinguished by a high fat removing power. Examples of compounds such as these, which also serve as nonionic surfactants, are fatty acid amides derived from ethanolamine, diethanolamine, propanolamine and isopropanolamine and also from alkylated diamines. Examples of diamines such as these are N,N-dimethylethylenediamine, N,N-dimethylpropylenediamine, N-methyl-N-ethylethylenediamine, N,N'-dimethylethylenediamine, N,N'-dimethylpropylenediamine, N-methyl-N'-ethylpropylenediamine and also mixtures of these alkylated alkylenediamines. The fatty acid residues present in the amides are derived from saturated or mono-unsaturated fatty acids containing from 10 to 18 and preferably from 12 to 18 carbon atoms, fatty acids in which more than 50% by weight and preferably more than 65% by weight of the acyl groups consist of those containing from 12 to 14 carbon atoms being particularly preferred. Mixtures obtained from coconut oil fatty acids, from which the fraction containing 10 carbon atoms and less has largely been separated, are particularly suitable.

Other nonionic surfactants belonging to this class are ethoxylated N-alkylamines containing on average from 1 to 3 ethylene glycolether groups and $C_{10}$–$C_{18}$ and more especially $C_{12}$–$C_{14}$ alkyl groups of the type present, for example, in cocosalkyl or oxo groups.

The impregnation of the granular adsorbent does not significantly affect its particle size distribution. However, any fines present, i.e., having a particle size less than 0.1 mm, are generally bound and cemented with the other particles, so that their percentage content is virtually zero. However, the powder density increases with the amount of nonionic surfactant applied. A further increase in the powder density may be obtained by subjecting the adsorbate to a final powdering treatment. Suitable powdering agents having a particle size of from 0.001 to at most 0.1 mm, and preferably of less than 0.05 mm, may be used in quantities of from 0.03 to 5% by weight and preferably in quantities of from 0.05 to 2% by weight, based on the impregnated adsorbent. Suitable powdering agents include, for example, finely powdered zeolites, silica aerogel (Aerosil®), colorless or colored pigments such as titanium dioxide, and other powder materials of the type already proposed for powdering granules or detergents particles, such as finely powdered sodium tripolyphosphate, sodium sulfate, magnesium silicate and carboxymethyl cellulose. The powdering treatment further improves the flow properties of the product and provides for even closer packing of the granulate particles. The powder component (A) may be provided with a powder density of from 450 to 800 g/l, depending on the choice of the granular adsorbent, the proportion of nonionic surfactants and the aftertreatment. By varying the quantitative ratio between the powder component (A) and the spray-dried powder component (B), the powder density of the mixture according to the invention may be adjusted within a wide range.

Starting out with the above composition of the granular adsorbent and the proportion of adsorbed nonionic surfactant, the powder component (A) has the following composition:

from 40 to 75% by weight and preferably from 45 to 70% by weight zeolite, from 2 to 15% by weight and preferably from 3 to 12% by weight (co)polymeric carboxylic acid, from 8 to 20% by weight and preferably from 10 to 18% by weight water removable at 145° C., from 0 to 20% by weight and preferably from 0 to 10% by weight sodium sulfate or sodium carbonate, from 10 to 50% by weight and preferably from 15 to 35% by weight nonionic surfactant, from 0 to 10% by weight and preferably 0.5 to 6% by weight of sodium nitrilotriacetate, from 0 to 5% by weight finely-divided powdering agent, and from 0 to 1% by weight optical brightener.

The granular powder component (B) contains anionic surfactants (constituent b). These anionic surfactants contain at least one hydrophobic hydrocarbon radical and a water-solubilizing sulfonate or sulfate group in the molecule. The hydrophobic radical may be an aliphatic $C_{10}$–$C_{20}$ and preferably $C_{12}$–$C_{18}$ hydrocarbon radical, which may be linear or methyl-branched in the 2-position, or an alkyl-aromatic radical containing from 8 to 14 and preferably from 10 to 12 aliphatic carbon atoms.

Preferred surfactants of the sulfonate type include linear alkylbenzene sulfonates ($C_9$–$C_{14}$ alkyl), mixtures of alkene and hydroxyalkane sulfonates and also disulfonates of the type obtained, for example, from monoolefins containing a terminal double bond by sulfonation with gaseous sulfur trioxide and subsequent alkaline or acidic hydrolysis of the sulfonation products. Alkane sulfonates obtainable from alkanes by sulfochlorination or sulfoxidation and subsequent hydrolysis or neutralization or by addition of bisulfites onto olefins are also suitable. Other suitable surfactants of the sulfonate type are the esters of -sulfofatty acids, for example the -sulfonic acids of hydrogenated methyl or etbylesters of coconut oil, palm kernel oil or tallow fatty acid.

Suitable surfactants of the sulfate type are the sulfuric acid monoesters of primary alcohols, for example, coconut oil fatty alcohols, tallow fatty alcohols or oleyl alcohol, and those of secondary alcohols. Sulfated reaction products of from 1 to 3 moles ethylene oxide with primary or secondary fatty alcohols are also suitable.

Soaps may also be used as anionic surfactants. Suitable soaps include, in particular, the sodium salts of saturated fatty acids containing from 12 to 18 carbon atoms, such as lauric, myristic, palmitic and stearic acid, and of oleic acid and mixtures thereof. Suitable mixtures are soaps obtained, for example, from tallow, coconut oil or palm kernel oil fatty acids. Where soaps are used, it is important to bear in mind that they intensify the expansion of the sprayed particles in the spraying tower. The result is that spray-drying mixtures rich in soap lead to particularly loose powders of low specific gravity.

Nonionic surfactants, which correspond in their constitution to the ethoxylates present in component (A), may also be used. However, it is preferred to use in component (B) only those nonionic surfactants which have a degree of ethoxylation of at least 5 or of which the hydrophobic radical contains at least 16 carbon atoms or which are characterized by both features. Nonionic surfactants such as these show very little tendency, if any, towards pluming. The weight per liter of the spray-dried powder component (B) may be increased by an addition of nonionic surfactants to the spray-drying mixture, i.e., these surfactants have the opposite effect of soaps. An addition of paraffins or silicone oils has the same effect. It is possible in this way to vary the weight per liter of component (B) to a certain extent, for example within limits of from 300 to 550 g/l and preferably within limits of from 320 to 500 g/l. On the other hand, the proportion of nonionic surfactants in component (B) should not be too high because, as already mentioned, this results in an increase in the viscosity of the slurry and in poorer flow of the spray-dried powder. Accordingly, a powder component (B) which contains very little, if any, nonionic surfactant, for example less than 5% by weight and more especially less than 2% by weight, based on component (B), is preferred.

Powder component (B) may contain zeolite corresponding to the above description as a constituent (c). This zeolite may also preferably be used in the form of a stabilized aqueous dispersion (of constituent A 1 of the granular adsorbent). Powder component (B) should be free of zeolite if powder component (B) contains water-soluble alkali metal silicates.

In addition, powder component (B) may contain polymeric carboxylic acids (constituent d) of the type described above (cf. constituent A 3 of the granular adsorbent). An addition such as this can improve the particle strength of the spray-dried product. However, where the overall content of this constituent in the detergent is small, i.e., less than 3%, it is of advantage for this constituent to be completely or largely present in powder component (A), because its particle-strengthening property is particularly pronounced in that component and of relevance to processibility.

The powder component (B) may contain sodium tripolyphosphate as an optional constituent (e). The amount of constituent (e) is limited with respect to the phosphate content of the total washing agent, which is less than 20% by weight (=4.5% by weight of P). Preferably the amount of tripolyphosphate in the total washing agent is 0 to 18.5% by weight and more preferably 0 to 10% by weight. In the powder component (B) the amount of sodium tripolyphosphate may be in the range of 0 to 50% by weight, preferably 0 to 40% by weight. These amounts are related to anhydrous phosphate. It was found that the hydrolysis of tripolyphosphate to orthophosphate and pyrophosphate is comparatively low.

The detergent auxiliaries which were collectively referred to as constituent (f) and which are stable and do not lose their activity under the spray-drying conditions include washing alkalis, sequestering agents, perborate stabilizers, neutral salts, redeposition inhibitors, optical brighteners and agents which reduce the viscosity of the slurry or which influence the powder density of the spray-dried product.

Suitable washing alkalis include sodium silicates having the ratio composition $Na_2O:SiO_2$ of 1:1 to 1:3.5, preferably 1:2 to 1:3.3, and most preferably 1:2.2 to 1:3. A further suitable washing alkali is sodium carbonate. Sodium bicarbonate and sodium borate may also be present. Sodium silicate increases detergency, has an anticorrosive effect and greatly improves the particle strength of the spray-dried product without, as in the case of powder component A, significantly reducing its dissolving rate. Accordingly, where the detergent according to the invention is required to contain sodium silicate, this should be present completely in component (B). Sodium carbonate present in component (B) improves the stability of the granular detergent mixture in storage, particularly under conditions of high humidity. Since, on the other hand, large amounts of sodium carbonate, for example above 15 to 20% by weight, promote incrustation of the washed fabrics, it is best to incorporate this optional constituent as far as possible, i.e., to an extent of from 75 to 100%, in powder component (B).

The group (f) constituent further includes the sequestering agents of the aminopolycarboxylic acid and polyphosphonic acid type which are generally present in relatively small amounts and which act as so-called cobuilders, stabilizers and precipitation inhibitors or threshold substances. The aminopolycarboxylic acids include nitrilotriacetic acid, ethylenediamine tetraacetic acid, diethylenetriamine pentaacetic acid and higher homologs thereof. Suitable polyphosphonic acids are 1-hydroxyethane-1, 1-diphosphonic acid, aminotrimethylenephosphonic acid, ethylenediamine tetramethylenephosphonic acid and higher homologs thereof, such as for example diethylenetriamine tetramethylenephosphonic acid. The polycarboxylic acids and polyphosphonic acids mentioned are normally used in the form of their sodium or potassium salts.

Suitable redeposition inhibitors include cellulose ethers, such as carboxymethyl cellulose, methyl cellulose, hydroxyalkyl celluloses and mixed ethers, such as methyl-hydroxyethyl cellulose, methylhydroxypropyl cellulose and methylcarboxymethyl cellulose. Mixtures of various cellulose ethers, particularly mixtures of carboxymethyl cellulose and methyl cellulose, are also suitable.

Suitable optical brighteners include alkali metal salts of 4,4'-bis-(2'-anilino-4'-morpholino-1,3,5-triazinyl-6''-amino)-stilbene-2,2'-disulfonic acid or compounds of similar structure which contain a diethanolamino group instead of the morpholino group. Brighteners of the substituted diphenylstyryl type, for example the alkali metal salts of 4,4'-bis-(2-sulfostyryl)-diphenyl, 4,4'-bis-(4-chloro-3-sulfostyryl)-diphenyl and 4-(4-chlorostyryl-4'-(2-sulfostyryl)-diphenyl, are also suitable.

Neutral salts, particularly sodium sulfate, in amounts of 0 to 25% by weight, preferably 1 to 10% by weight, and textile softening layered silicates such as smectites in amounts of 0 to 22%, preferably 0 to 15% by weight may be used as further constituents of powder component (B). Further detergent auxiliaries include additives which improve the structure of the powder, for example alakli metal salts of toluene, cumeme or xylene sulfonic acid.

Accordingly, powder component (B) preferably has the following composition:

from 0 to 5% by weight nonionic surfactant;

from 10 to 25% by weight and preferably from 12 to 20% by weight sulfonate or sulfate surfactant;

from 0 to 6% by weight and preferably from 1 to 5% by weight soap;

from 0 to 50% by weight and preferably from 0 to 40% by weight sodium tripolyphosphate;

from 0 to 5% by weight and preferably from 0 to 3% by weight (co)polymeric carboxylic acid, in the form of sodium or potassium salts;

from 0 to 12% by weight and preferably from 2 to 10% by weight sodium silicate;

from 0 to 10% by weight and preferably from 0 to 5% by weight sodium carbonate;

from 0.1 to 2% by weight and preferably from 0.2 to 1% by weight sequestering agent of the aminopolycarboxylic acid and aminopolyphosphonic acid type in the form of sodium or potassium salts;

from 0.5 to 3% by weight redeposition inhibitors;

from 0 to 1% by weight optical brighteners;

from 0 to 20% by weight neutral salts, such as sodium sulfate, powder improving additives and stabilizers, such as magnesium silicate; and from 8 to 20% by weight adsorbed water.

Component (B) may be prepared under the same conditions as described above for the production of the granular adsorbent.

In addition to the granular powder components (A) and (B), the detergents may contain further powder components as mixture constituents. These further powder components contain substances which are unstable or which completely or partly lose their specific effect under the spray-drying conditions. The substances in question include, for example, enzymes, bleaches, bleach activators, foam inhibitors and perfumes.

Suitable enzymes include those from the class of proteases, lipases and amylases and mixtures thereof. Enzymatic agents obtained from bacterial strains or fungi, such as *Bacillus subtilis, Bacillus licheniformis* and *Streptomyces griseus,* are particularly suitable. The enzymes may be adsorbed on carriers and/or embedded in shell-forming substances to protect them against premature decomposition. The enzymes are also preferably present as granulates of comparable particle size distribution in order to prevent separation.

Suitable bleaching components include the perhydrates and per compounds normally used in detergents and bleaches. Preferred perhydrates are sodium perborate which may be present as the tetrahydrate or even as the monohydrate, the perhydrates of sodium carbonate such as sodium percarbonate, of sodium pyrophosphate such as perpyrophosphate, of sodium silicate such as persilicate, and urea. Sodium perborate tetrahydrate or monohydrate is preferably used.

Another optional powder component is the bleach activators. The bleach activators include in particular N-acyl compounds and O-acyl compounds. Examples of suitable N-acyl compounds are polyacylated alkylenediamines, such as tetraacetylmethylenediamine, tetraacetylethylenediamine and higher homologs thereof and also acylated glycolurils, such as tetraacetylglycoluril. Further examples include sodium-cyanamide, N-alkyl-N-sulfonyl carbonamides, N-acyl-hydantoins, N-acylated cyclic hydrazides, triazoles, urazoles, diketopiperazines, sulfurylamides, cyanurates and imidazolines. In addition to carboxylic acid anhydrides, such as phthalic acid anhydride, and esters, such as sodium (iso)-nonanoyl pbenolsulfonate, suitable O-acyl compounds include, in particular, acylated sugars, such as glucose pentaacetate. Preferred bleach activators are tetraacetyl ethylenediamine and glucose pentaacetate. The bleach activators may also be granulated and coated with shell-forming materials to avoid any interaction with the per compounds. Since foam inhibitors, except for high molecular weight fatty acid soaps, frequently lose all or part of their effect on incorporation in the detergent slurry, they are best also added to the detergent as a separate powder component. Suitable foam inhibitors include organopolysiloxanes and mixtures thereof with micro-fine, optionally silanized silica, paraffins, waxes, microcrystalline waxes and mixtures thereof with silanized silica. Mixtures of various foam inhibitors, for example mixtures of silicones and paraffins, may also be used. The foam inhibitors are preferably fixed to a granular carrier soluble or dispersible in water and, in this form, have a particle size distribution corresponding to that of components (A) and (B).

Where perfumes are used, they may be applied to one of the powder components. Likewise, one or more of the powder components may be colored or coated with pigments, for example to mask the natural color of active agents or to provide the powder mixture with a mottled appearance.

The average particle size or the percentage of the individual sieve fractions of the granular powder components (A) and (B) should not differ from one another by more than 50% by weight. The content of fines, i.e., particle size below 0.1 mm, and of coarse grain, i.e., particle size above 1.6 mm, should amount to no more than 1% by weight in either case. It has been found that, if these conditions are observed, there is no danger of the two powder components separating, for example during transport, even when the two components differ considerably in their respective weights per liter. The other powder constituents are also best used in a granular form which does not differ significantly, i.e., by more than 30% by weight, in its particle size distribution from that of components (A) and (B).

The ratio in which components (A) and (B) are mixed is in the range of from 1:5 to 3:1 and preferably in the range of from 1:4 to 2:1 and should be selected so that the distribution ratio of constituents (a), (c) and (d) remains within the definition according to the invention. The percentage content of the optional powder components may vary within relatively wide limits. In the final mixture, the percentage content of the per compound, preferably perborate, is from 5 to 30% by weight and preferably from 7 to 25% by weight. Bleach activators may be present in quantities of from 0.2 to 5% by weight. As already mentioned, both additives are preferably used in granulated form. Because they generally require only relatively small amounts of granulation aids (generally less than 10%, based on active substance) for conversion into stable granulates, their percentage content largely corresponds to the actual active substance content. Enzymes and foam inhibitors are normally used in quantities of from 0.01 to at most 2% by weight and preferably in quantities of from 0.05 to 1% by weight, based on active substance. However, in the active substance granulates, the percentage content of carrier, fillers and coating materials dominates by far, frequently amounting to more than 90% by weight. Accordingly, the percentage content of these granular powder constituents in the mixture as a whole is generally from 0.3 to 5% by weight in each case.

The dosing and subsequent mixing of components (A) and (B) and the additional powder components may be carried out either in individual steps or even at the same time. Dosing and mixing are best carried out continuously, with automatic belt weighers in combination with free-fall mixers having proven to be particularly suitable for this purpose. There is generally no need for additional mechanically operated mixers. If they are used, it is advisable to provide for careful treatment of the powder mixture in order to avoid destruction of the hollow bead structure of the spray-dried powder and an undesirable increase in the proportion of fines and dust.

The detergents according to the invention are distinguished by high detergency, particularly with respect to difficult fatty soil. Despite their comparatively high content of liquid nonionic surfactants, they pour and flow freely and show no tendency to seep through cardboard packs.

EXAMPLES I–V

An absorbent having the following composition (PBW=part by weight) was prepared by spray drying in accordance with German patent application No. P 34 44 960.4:

| | |
|---|---|
| 47.8 PBW | zeolite NaA (based on anhydrous substance) |
| 5.2 PBW | polycarboxylic acid (sodium salt) copolymer |
| 1.6 PBW | ethoxylated tallow alcohol (part of component al) |
| 2.0 PBW | sodium sulfate |
| 13.7 PBW | water, including 7.4 PBW removable at 145° C. |
| 70.3 PBW | |

The zeolite used had a particle size of from 1 to 8 microns, the proportion of particles larger than 8 microns amounting to 6% by weight. There were no particles larger than 20 microns. The polycarboxylic acid used was a copolymer of acrylic acid and maleic acid (molar ratio 7:3) having an average molecular weight of 70,000 in the form of the sodium salt. A tallow alcohol (30% cetyl alcohol, 70% stearyl alcohol) reacted with 5 moles ethylene oxide (EO) was used as the ethoxylated fatty alcohol.

The grain spectrum determined by sieve analysis produced the following weight distribution:

| mm | Over 1.6 | Up to 0.8 | Up to 0.4 | Up to 0.2 | Up to 0.1 | Under 0.1 |
|---|---|---|---|---|---|---|
| % by weight | 0 | 3 | 33 | 52 | 12 | 1.0 |

The weight per liter was 550 g/l.

82.9 parts by weight of the granulate were sprayed with 17.1 parts by weight of a molten nonionic surfactant mixture in a spray-mixing apparatus consisting of a cylindrical drum equipped with mixing elements and spray nozzles and inclined relative to the horizontal (LODIGE mixer). The temperature of the granulate was 20° C. and the temperature of the surfactant melt was 50° C. The surfactant mixture consisted of 16.7 parts by weight of tallow alcohol containing 5 moles EO, and 13 parts by weight of a lauryl alcohol-myristyl alcohol mixture (2:1) containing 3 moles EO. A non-tacky, granular product showing excellent flow properties was obtained after cooling. The powder density was 650 g/l; the grain spectrum was virtually unchanged except that the proportion of particles smaller than 0.1 mm was 0%.

27 parts by weight of the granulate impregnated with the nonionic surfactant (powder component A) were mixed with 44.2 parts by weight of a spray-dried powder (powder component B). The spray-dried powder component (B) contained sodium dodecylbenzene sulfonate (Na-DBS), sodium tallow soap, sodium ethylenediamine tetramethylene phosphonate (EDTMP), cellulose ether (CMC), sodium silicate ($Na_2O:SiO_2$ ratio of 1:3.3) and the other constituents shown in Table 1. Granulated enzymes, granulated silicone foam inhibitor containing 94.5% of a mixture of sodium carbonate (soda), sodium sulfate and sodium silicate as granulation aid, sodium perborate and granulated tetraacetyl ethylenediamine (TAED) containing 5.8% CMC and sodium sulfate as granulation aid were added as further powder constituents. These powder-form or granular constituents are collectively referred to as "powder component C", of which the total quantity amounts to 15.3 parts by weight.

The composition of the detergent and of other similarly prepared detergents is shown in Table 1 in % by weight.

In Examples 3, 4 and 5, powder component (A) was powdered with 3% by weight (based on component A) of zeolite NaA powder after application of the nonionic surfactant.

TABLE 1

| Component | Examples 1 | 2 | 3 | 4 | 5 |
|---|---|---|---|---|---|
| A | | | | | |
| $C_{16}$–$C_{18}$ alcohol + 5 moles EO | 3.9 | 4.3 | 4.3 | 3.5 | 3.5 |
| $C_{12}$–$C_{14}$ alcohol + 3 moles EO | 0.9 | 1.1 | 0.9 | 1.0 | 1.6 |
| Zeolite | 14.1 | 24.3 | 18.4 | 16.3 | 16.0 |
| Copolymer | 3.6 | 4.0 | 2.0 | 4.0 | 4.2 |
| Sodium-NTA | — | — | 3.2 | — | — |
| Sodium sulfate | 0.5 | — | 0.3 | 0.5 | 2.0 |
| Water | 4.0 | 6.8 | 4.8 | 4.9 | 4.5 |
| B | | | | | |
| $C_{16}$–$C_{18}$ alcohol + 5 moles EO | 0.4 | — | — | 1.1 | — |
| Na-DBS | 7.0 | 6.0 | 7.5 | 7.0 | 7.5 |
| Soap | 1.5 | 1.5 | 1.0 | 1.5 | 1.5 |
| Zeolite NaA | 10.9 | — | — | — | — |
| Sodium tripolyphosphate | — | — | — | — | 16.0 |
| Copolymer | 0.4 | — | — | — | — |
| Sodium carbonate | 7.1 | 10.0 | 7.0 | 8.0 | 5.0 |
| EDTMP | 0.2 | 0.2 | 0.2 | 0.2 | 0.2 |
| Sodium sulfate | 11.0 | 7.4 | 5.1 | 12.6 | 10.3 |
| Layered silicate | — | — | 14.0 | 12.4 | — |
| Water | 5.7 | 3.0 | 7.2 | 4.7 | 4.0 |
| C | | | | | |
| Enzyme granulate | 0.5 | 0.5 | 0.5 | 0.5 | 0.5 |
| Sodium perborate | 25.0 | 20.0 | 15.0 | 18.0 | 15.0 |
| TAED granulate | — | 2.0 | 2.0 | 2.1 | 2.0 |
| Foam inhibitor granulate | 3.1 | 3.0 | 3.1 | 3.1 | 3.0 |
| Perfume | 0.2 | 0.2 | 0.2 | 0.2 | 0.2 |
| g/l of Component A | 650 | 630 | 670 | 710 | 730 |
| g/l of Component B | 340 | 330 | 330 | 530 | 440 |
| g/l of the mixture | 500 | 480 | 490 | 630 | 580 |

We claim:

1. The process of preparing a phosphate-reduced detergent composition comprising spray-drying an aqueous mixture (A) comprising: (a) from about 20 to about 30 parts by weight of finely-divided crystalline zeolite; (b) from about 0.5 to about 7.5 parts by weight of a homopolymeric or copolymeric carboxylic acid having a molecular weight of from about 1000 to about 120,000 and the sodium or potassium salt thereof; and (c) from about 50 to about 65 parts by weight of water, to produce particles having a water content, which is removable at about 145° C., of from about 8 to about 18 parts by weight; (d) impregnating said particles with 0 to about 2 parts by weight of a nonionic surfactant; (e) recovering particles having an average particle size of from about 0.4 to about 0.8 mm wherein the percentage of particles larger than about 1.6 mm and the percentage of particles smaller than about 0.1 mm does not exceed about 1% by weight in either case, said particles having a powder density of from about 450 to about 800 g/l; (f) spray-drying an aqueous mixture (B) to provide granular particles comprising (1) from 0 to about 5% by weight of nonionic surfactant; (2) from about 10 to about 25% by weight of anionic surfactant; (3) from about 0 to about 6% by weight of soap; (4) from 0 to about 50% by weight of sodium tripolyphosphate; (5) from 0 to about 5% by weight of polymeric carboxylic acid and the sodium or potassium salt thereof; (6) from about 0 to about 12% by weight of sodium silicate; (7) from 0 to about 10% by weight of sodium carbonate; (8) from about 0.1 to about 2% by weight of a sequestering agent; (9) from about 0.5 to about 3% by weight of redeposition inhibitor; (10) from 0 to about 1% by weight of optical brighteners; (11) from 0 to about 20% by weight of neutral salt; and (12) from about 8 to about 20% by weight of adsorbed water; said particles having a powder density of from about 300 to about 550 g/l and a particle size distribution which differs by not more than about 50% from that of the particles obtained from spray-drying said aqueous mixture (A); and mixing said particles obtained from spray-drying said aqueous mixture (A) with said particles obtained from spray-drying said aqueous mixture (B) in a weight ratio of from about 1:5 to about 3:1.

2. The process of claim 1 wherein said carboxylic acid is selected from the group consisting of polyacrylic acid; polymethacrylic acid, polymaleic acid, a copolymer of acrylic acid and methacrylic acid, and a copolymer of acrylic acid, methacrylic acid or maleic acid with vinyl ether, vinyl ester, acrylamide, methacrylamide, ethylene, propylene, and styrene.

3. The process of claim 1 wherein said anionic surfactant is selected from the group consisting of linear alkylbenzene sulfonate, a mixture of alkene and hydroxyalkane sulfonate and disulfonate, sulfonated ester of α-sulfofatty acid, and sulfated sulfuric acid monoester of primary alcohol and secondary alcohol.

4. The process of claim 1 including mixing said particles obtained from spray-drying said aqueous mixture (A) with from about 0.03% to about 5% by weight of zeolite particles.

5. The process of claim 1 wherein the drying gases employed in said spray-drying process have an entry temperature of from about 150° to about 280° C., and an exit temperature of from about 50° to about 120° C.

6. The process of claim 1 wherein said aqueous mixture (A) and said aqueous mixture (B) are spray-dried under a spraying pressure of from about 20 to about 120 bar.

7. The process of claim 1 wherein said aqueous mixture (A) has a viscosity of from about 5000 to about 20,000 mPa.s at a temperature from about 50° to about 100° C.

8. The process of claim 1 wherein said nonionic surfactant is selected from the group consisting of a polyglycol ether derivative, and an ethoxylated alcohol containing from about 12 to about 18 carbon atoms and from about 3 to about 15 ethylene glycolether groups.

9. The process of claim 1 including mixing said particles obtained from spray-drying said aqueous mixture (A) with from about 0.03 to about 5% by weight of a powdering agent selected form the group consisting of silica aerogel, magnesium silicate, carboxymethyl cellulose, titanium dioxide, pigment, and finely-divided sodium tripolyphosphate.

10. The process of claim 1 wherein said carboxylic acid is a copolymer containing from about 40 to about 90% by weight of acrylic acid and from about 50 to about 10% by weight of maleic acid.

11. The process of claim 1 wherein said redeposition inhibitor comprises a cellulose ether.

12. The product prepared by spray-drying an aqueous mixture (A) comprising: (a) from about 20 to about 30 parts by weight of finelydivided crystalline zeolite; (b) from about 0.5 to about 7.5 parts by weight of a homopolymeric or copolymeric carboxylic acid having a molecular weight of from about 100 to about 120,000 and the sodium or potassium salt thereof; and (c) from about 50 to about 65 parts by weight of water, to produce particles having a water content, which is removable at about 145° C., of from about 8 to about 18 parts by weight; (d) impregnating said particles with 0 to about 2 parts by weight of a nonionic surfactant; (e) recovering particles having an average particle size of from about 0.4 to about 0.8 mm wherein the percentage of particles larger than about 1.6 mm and the percentage of particles smaller than about 0.1 mm does not exceed about 1% by weight in either case, said particles having a powder density of from about 450 to about 800 g/l; (f) spray-drying an aqueous mixture (B) to provide granular particles comprising (1) from 0 to about 5% by weight of nonionic surfactant; (2) from about 10 to about 25% by weight of anionic surfactant; (3) from about 0 to about 6% by weight of soap; (4) from 0 to about 50% by weight of sodium tripolyphosphate; (5) from 0 to about 5% by weight of polymeric carboxylic acid and the sodium or potassium salt thereof; (6) from about 0 to about 12% by weight of sodium silicate; (7) from 0 to about 10% by weight of sodium carbonate; (8) from about 0.1 to about 2% by weight of a sequestering agent; (9) from about 0.5 to about 3% by weight of redeposition inhibitor; (10) from 0 to about 1% by weight of optical brighteners; (11) from about 0 to about 20% by weight of neutral salt; and (12) from about 8 to abut 20% by weight of adsorbed water; said particles having a powder density of from about 300 to about 550 g/l and a particle size distribution which differs by not more than about 50% from that of the particles obtained from spray-drying said aqueous mixture (A); and mixing said particles obtained from spray-drying said aqueous mixture (A) with said particles obtained from spray-drying said aqueous mixture (B) in a weight ratio of from about 1:5 to about 3:1.

13. The product prepared in accordance with claim 12 wherein said carboxylic acid is selected for the group consisting of polyacrylic acid; polymethacrylic acid, polymaleic acid, a copolymer of acrylic acid and methacrylic acid, and a copolymer of acrylic acid, methacrylic acid or maleic acid with vinyl ether, vinyl ester, acrylamide, methacrylamide, ethylene, propylene, and styrene.

14. The product in accordance with claim 12 wherein said anionic surfactant is selected from the group consisting of linear alkylbenzene sulfonate, a mixture of alkene and hydroxyalkane sulfonate and disulfonate, sulfonated ester of α-sulfofatty acid, and sulfated sulfuric acid monoester or primary alcohol and secondary alcohol.

15. The product prepared in accordance with claim 12 wherein said particles obtained from spray-drying said aqueous mixture (A) are mixed with from about 0.03% to about 5% by weight of zeolite particles.

16. The product prepared in accordance with claim 12 wherein the drying gases employed in said spray-drying process have an entry temperature of from about 150° to about 280° C., and an exit temperature of from about 50° to about 120° C.

17. The product prepared in accordance with claim 12 wherein said aqueous mixture (A) and said aqueous mixture (B) are spray-dried under a spraying pressure of from about 20 to about 120 bar.

18. The product prepared in accordance with claim 12 wherein said aqueous mixture (A) has a viscosity of from about 5000 to about 20,000 mPa.s at a temperature of from about 50° to about 100° C.

19. The product prepared in accordance with claim 12 wherein said nonionic surfactant is selected from the group consisting of a polyglycol ether derivative, and an ethxoylated alcohol containing from about 12 to about 18 carbon atoms and from about 3 to about 15 ethylene glycolether groups.

20. The product prepared in accordance with claim 12 wherein said particles obtained from spray-drying said aqueous mixture (A) are mixed with from about 0.03 to about 5% by weight of a powdering agent selected from the group consisting of silica aerogel, magnesium silicate, carboxymethyl cellulose, titanium dioxide, pigment, and finely-divided sodium tripolyphosphate.

21. The product prepared in accordance with claim 12 wherein said carboxylic acid is a copolymer containing from about 40 to about 90% by weight of acrylic acid and from about 50 to about 10% by weight of maleic acid.

22. The product prepared in accordance with claim 12 wherein said redeposition inhibitor comprises a cellulose ether.

* * * * *

UNITED STATES PATENT AND TRADEMARK OFFICE

CERTIFICATE OF CORRECTION

PATENT NO. : 4,849,125

DATED : July 18, 1989

INVENTOR(S) : Seiter et al

It is certified that error appears in the above-identified patent and that said Letters Patent is hereby corrected as shown below:

In Claim 9, at Col. 16, line 13, "form" should read --from--.

In Claim 12, at Col. 16, line 28, "100" should read --1000--.

Signed and Sealed this

Twenty-second Day of May, 1990

*Attest:*

HARRY F. MANBECK, JR.

*Attesting Officer*

*Commissioner of Patents and Trademarks*